US005138787A

United States Patent [19]

Riddle et al.

[11] Patent Number: 5,138,787

[45] Date of Patent: Aug. 18, 1992

[54] DEVICE FOR CATCHING AND HOLDING RIFLE SHELL CASINGS EJECTED FROM A RIFLE

[75] Inventors: Ronald E. Riddle, Swansea; Travis O. Riddle, Columbia, both of S.C.

[73] Assignee: Riddle Corporation, Swansea, S.C.

[21] Appl. No.: 678,698

[22] Filed: Apr. 1, 1991

[51] Int. Cl.[5] ..... F41C 27/00; F41A 9/60

[52] U.S. Cl. ..... 42/98

[58] Field of Search ..... 42/98; 89/33.4

[56] References Cited

U.S. PATENT DOCUMENTS

| | | | |
|---|---|---|---|
| 1,027,509 | 5/1912 | Smiley | 42/98 |
| 2,354,277 | 6/1943 | Richardson | 42/98 |
| 2,866,289 | 12/1958 | Wilcox | 42/98 |
| 3,153,981 | 10/1964 | Brass | 42/98 |
| 3,156,991 | 4/1962 | Adams | 42/98 |
| 3,618,458 | 11/1971 | Pruonto et al. | 42/98 |
| 3,739,685 | 6/1973 | Lundgren | 42/98 |
| 4,028,834 | 6/1977 | Dobson | 42/98 |
| 4,166,333 | 9/1979 | Kratzer | 42/98 |
| 4,204,353 | 5/1980 | Isola | 42/98 |
| 4,334,375 | 6/1982 | Olson | 42/98 |
| 4,691,615 | 9/1987 | Brunton | 42/98 |
| 4,715,141 | 12/1987 | Kohnke | 42/98 |
| 4,959,918 | 10/1990 | Perez | 42/98 |

FOREIGN PATENT DOCUMENTS

| | | | |
|---|---|---|---|
| 2424719 | 1/1975 | Fed. Rep. of Germany | 42/98 |

*Primary Examiner*—Charles T. Jordan

*Attorney, Agent, or Firm*—Shefte, Pinckney & Sawyer

[57] ABSTRACT

A device for catching and holding rifle shell casings ejected from a conventional M16 or like rifle includes a deflector body mounted between the handle and main body portions of the rifle by a spring-loaded detent assembly engageable in an opening conventionally formed in the rifle handle, thereby positioning the deflector body adjacent the shell ejection port of the rifle body. A shell collection bag is removably attached to the deflector body to receive and contain shells discharged through the ejection port.

5 Claims, 2 Drawing Sheets

DEVICE FOR CATCHING AND HOLDING RIFLE SHELL CASINGS EJECTED FROM A RIFLE

BACKGROUND OF THE INVENTION

The present invention relates generally to rifles, and more particularly, to devices for catching and holding rifle shell casings ejected from a rifle, especially automatic and semi-automatic military and sporting rifles.

Typically, automatic and semi-automatic military and sporting rifles are provided with an ejection port formed in the rifle body adjacent the shell firing chamber for laterally ejecting spent shell casings after each firing of the rifle. Representative examples of such rifles are the M16-A1 and M16-A2 automatic military rifles used by the United States military branches and many law enforcement agencies and the AR-15 and CAR-15 semiautomatic sporting rifles which are sold through sporting goods suppliers and like outlets throughout the United States.

Since the greatest proportion of military personnel and sportsmen shoot a rifle in a right-handed manner, i.e., with the rifle butt stabilized against the right shoulder and the rifle barrel supported by the left hand for trigger operation by the right hand, the shell ejection port in such rifles is formed in the right-hand side of the rifle body for shell ejectment laterally away from the shooter. Disadvantageously, however, when such rifles are used by left-handed shooters, the hot shell casings tend to be ejected toward the body of the shooter and have been known to cause a left-handed shooter to accidentally discharge the rifle when struck by a discharged shell, thereby posing a substantial danger to bystanders, e.g., other shooters and spectators on a rifle range. At least one such accidental discharge of a rifle has resulted in death. Moreover, even with right-handed shooters, because such rifles tend to discharge spent shells with considerable force, typically sufficient to propel a discharged shell 5-10 feet, a danger exists on rifle ranges and in other situations involving two or more shooters in relatively close proximity to one another that one shooter's discharged shells may strike an adjacent shooter and cause him similarly to accidentally fire his rifle.

Apart from such potential danger, spent shell casings are, in any event, discharged onto the surrounding ground at the shooting location, necessitating pick-up of the spent shells after shooting is completed. Shell clean-up is particularly a problem at military rifle ranges and the like used for instructional purposes. Because of the large number of rifle firings taking place on a regular basis at such ranges, the number of discharged shells to be retrieved is considerable, sometimes necessitating complete closing of the range for a sufficient period of time to retrieve all spent shells from the grounds.

SUMMARY OF THE INVENTION

It is accordingly an object of the present invention to provide a novel device for catching and holding spent shell casings ejected from a rifle of the aforementioned type to prevent discharged shells from striking a shooter and to eliminate the necessity of pick-up of spent shell casings from a rifle range or other shooting location.

The device of the present invention is basically designed and intended for attachment to and detachment from substantially any rifle of the type having a rifle body and a shell ejection port and an opening formed generally adjacent one another in the rifle body. For example, the aforementioned automatic M16-A1 and M16-A2 automatic military and law enforcement rifles and the AR-15 and CAR-15 semi-automatic sporting rifles have a handle portion of the rifle body with a hole through the handle in facing relation to the main body portion of the rifle body generally adjacent the rifle's shell ejection port.

In its most basic aspect, the present device comprises a container assembly defining a shell containment area and having a shell deflecting portion for directing ejected shell casings into the containment area. A detent arrangement is provided on the container assembly for engagement and disengagement from the opening in the rifle body for selectively mounting the container assembly with its shell deflecting portion in facing relation to the shell ejection port of the rifle.

Preferably, the containment area of the container assembly is formed by a flexible bag having a stretchable edge portion defining an entrance opening into the containment area. The deflecting portion of the container assembly is formed with a lip for retaining engagement with the edge portion of the bag, thereby enabling the bag to be selectively attached to and detached from the shell deflecting portion of the container assembly.

The preferred embodiment of the present device is particularly designed for use with the aforementioned M16-A1, M16-A2, AR-15, and CAR-15 rifles. More specifically, the detent arrangement of the present device includes a shoulder for engagement with the main body portion of the rifle body, a button or other engagement member mounted on the shoulder to be in adjacent facing relation to the hole in the rifle's handle portion when the shoulder is positioned in engagement with the main body portion, and a yieldable biasing device, such as a spring, for urging the engagement member into the hole. The shell deflecting portion of the present device is also provided with a flange for lateral engagement with the rifle handle when the shoulder and engagement member are engaged respectively with the main body portion and the handle hole, as described.

DESCRIPTION OF THE PREFERRED EMBODIMENT

Figure 1:
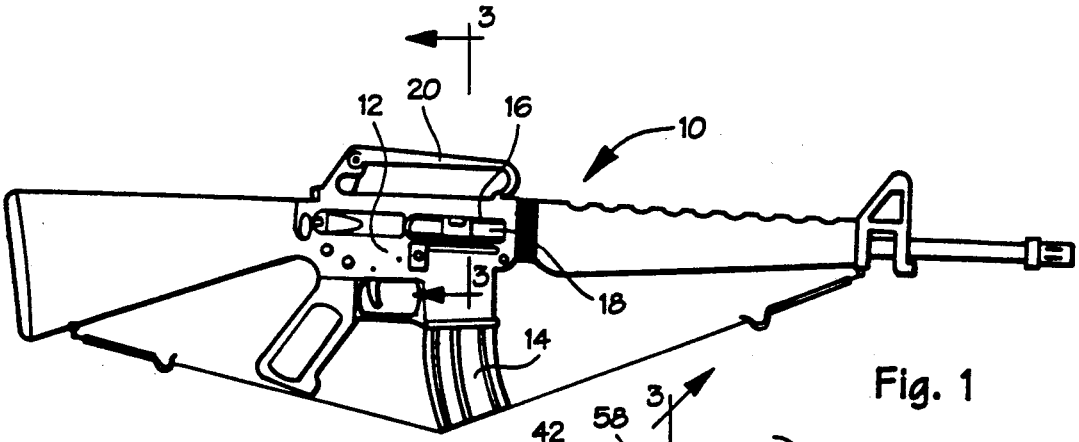
FIG. 1 is right side elevational view of a conventional M16-A1 automatic military-style rifle for which the preferred embodiment of the device of the present invention is designed.

Referring now to the accompanying drawings and initially to FIG. 1, a conventional military-style M16-A1 automatic rifle is shown generally at 10 for purposes of facilitating an understanding of the preferred embodiment of the device of the present invention. The preferred embodiment of the present device is also equally usable with like conventional military M16-A2 rifles and civilian sportsman AR-15 and CAR-15 rifles because of their structural similarities to the M16-A1 rifle. However, those persons skilled in the art will readily recognize and understand that the potential applications for the concepts of the present invention are not limited to these rifles and, accordingly, the present invention is not intended to be so limited in scope.

The basic construction and operation of the rifle 10 of FIG. 1 is well-known and, therefore, need not be explained herein except to the limited extent necessary to facilitate an understanding of the device of the present invention. In pertinent part, the body of the rifle 10 has a main rifle body portion 12 interiorly defining a firing chamber (not shown) which is automatically supplied sequentially with cartridges (also not shown) from a magazine 14. An ejection port 16 is formed in the right-hand side of the main body portion 12 for discharge through the port 16 of spent shells ejected in sequence from the firing chamber after each cartridge is fired. A foldable cover 18 is mounted to the main body portion 12 for selective pivotable movement into and out of covering relation with the ejection port 16. The rifle body further includes a handle portion 20 extending along the length of the main body portion 12 in spaced facing parallel relation to the upper side of the main body portion 12. A hole 22 (FIG. 3) is formed through the handle portion 20 at a forward location generally adjacent the ejection port 16.

Figure 2:
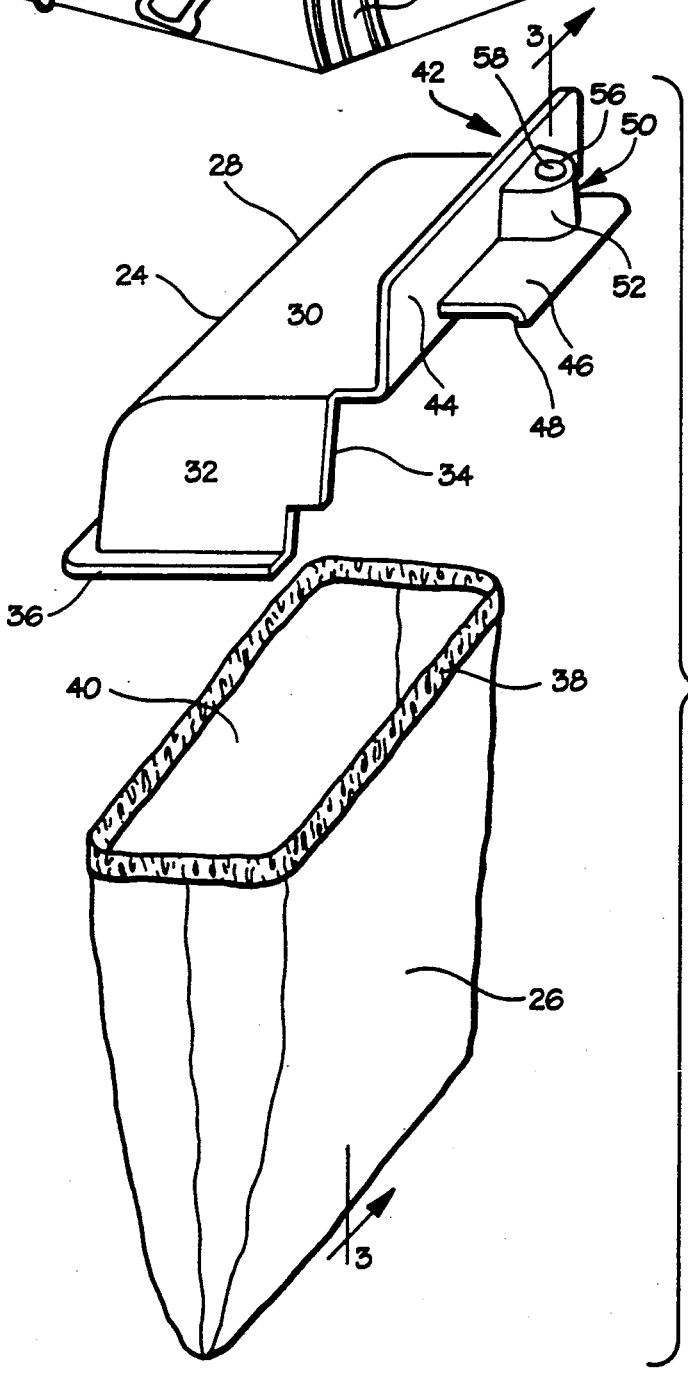
FIG. 2 is an exploded perspective view of the preferred embodiment of the device of the present invention.
Figure 3:
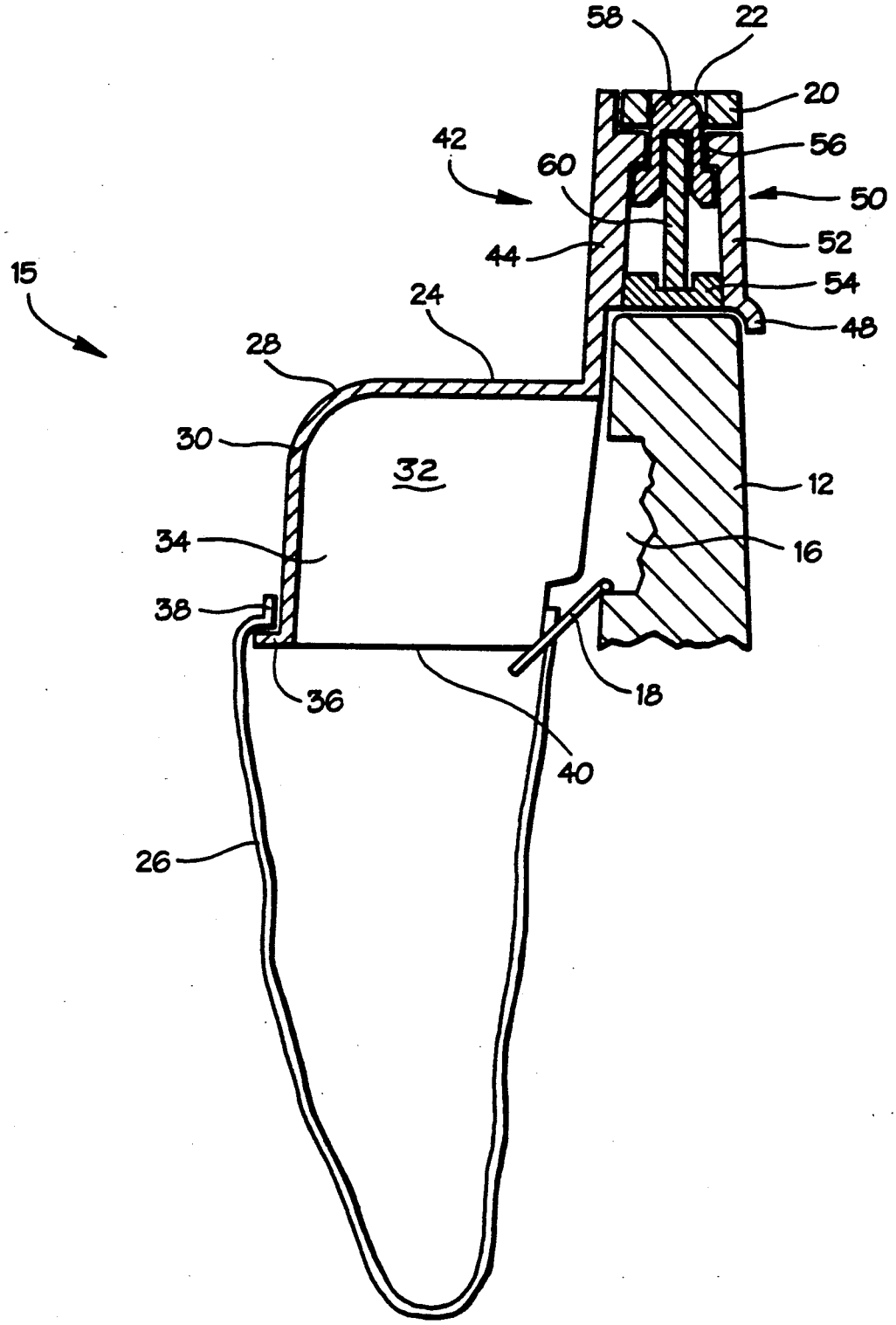
FIG. 3 is a vertical cross-sectional view of the present device of FIG. 2 and the rifle of FIG. 1, in assembled relation, taken along line 3—3 shown in each figure.

The shell catching device of the present invention is indicated generally at 15 in FIGS. 2 and 3 and basically includes a shell deflector assembly 24 adapted to be detachably mounted to the main rifle body portion 12 and a shell collection bag 26 for removable attachment to the deflector assembly 24 The shell deflector assembly 24 includes a main deflector body 28 of a generally concave shape formed by a longitudinal angularly curved deflection wall 30 merging at its opposite ends with transversely extending end walls 32 to collectively define an interior deflection area 34 which is open at its bottom and one lateral side. An outwardly extending lip 36 is formed continuously along the downwardly facing edges of the longitudinal and end walls 30 and 32.

The shell deflector assembly 24 further includes a mounting assembly, generally indicated at 42 at the upper lateral edge of the longitudinal deflector wall 30. The mounting assembly 42 includes a first substantially planar flange 44 extending in upstanding disposition along the laterally facing upper longitudinal edge of the deflector wall 30 and a second substantially planar flange 46 extending outwardly from the side of the flange 44 opposite the deflector wall 30 in substantially perpendicular relation to the flange 44 with a downwardly curved lip portion 48 formed along the outward edge of the flange 46. A detent assembly 50 is affixed to each flange 44,46 and includes a generally hollow upstanding detent housing 52 closed at its lower end by a plug 54 and defining a detent opening 56 in its upper end. Within the hollow interior of the detent housing 52, a generally bell-shaped detent member 58 is slidably disposed and is biased to protrude upwardly through the opening 56 by a conventional coil spring 60 extending between the plug 54 and the detent member 58.

The shell collection bag 26 is preferably fabricated of a suitably flexible material, e.g., cloth, canvas, plastic, or the like, closed on all sides except at a stretchable elasticized cuff portion 38 defining a shell entrance opening 40 at the upper end of the bag 26. The elasticized cuff portion 38 enables the collection bag 26 to be readily attached to and detached from the deflector body 28 of the shell deflector assembly 24 directly above its lip 36 to retain the bag 26 in place on the deflector body 28.

The operation of the shell catching device 15 of the present invention may thus be understood. As best seen in FIG. 3, the mounting assembly 42 on the shell deflector assembly 24 is configured and dimensioned for insertion of the detent assembly 50 between the handle portion 20 and the main body portion 12 of the rifle 10, the biasing spring 60 being yieldable to permit the detent member 58 to retract within the opening 56 and then to re-extend outwardly therefrom into the hole 22 in the rifle handle portion 20 to engage the shell deflector assembly 24 in place on the rifle body portion 12. In such disposition, the upright flange 44 engages the rightwardly facing lateral side surfaces of the rifle body portion 12 and the handle portion 20 while the horizontal flange 46 rests in superposed relation on the upwardly facing surface of the rifle body portion 12, with the outward lip 48 of the flange 46 extending slightly over the opposite lateral side of the rifle body portion 12 to retain the shell deflector assembly 24 in place.

In such disposition, the lengthwise deflector wall 30 is oriented in direct facing relation to the ejection port 16 in the rifle body portion 12 at a spacing therefrom defined by the deflector body's interior deflection area 34. The shell collection bag 26 may still be readily attached to and detached from the deflector body 28 in its mounted disposition as described With the collection bag 26 supported on the deflector body 28, the bag 26 is disposed to receive the ejection port cover 18 of the rifle 10 when folded downwardly for rifle firinq, as depicted in FIG. 3. Upon subsequent firing of the rifle 10, spent shells ejected through the ejection port 16 are intercepted and deflected by the deflector body 28 into the collection bag 26. Preferably, the collection bag 26 is of a sufficient size to contain forty or more spent shells, i.e., the capacity of two or more cartridge magazines. When firing is completed, or when the collection bag 26 reaches its full capacity, the bag 26 may simply be detached from the deflector body 28 and emptied for recycling of the shells. Advantageously, the present shell catching device, therefore, prevents any spent shells from being discharged onto the surrounding ground to require later pick-up and prevents any accidental undesired discharge of spent shells into contact with the body of the rifle shooter or an adjacent shooter, thus overcoming the problems described above.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. A device attachable to and detachable from a rifle of the type having a rifle body with a main body portion and a handle portion spaced from the main body portion, and a shell ejection port formed in the main body portion and an opening formed in the handle portion in facing relation to the main body portion, for catching and holding rifle shell casings ejected from the rifle, said device comprising container means defining a shell containment area and having a shell deflecting portion for directing ejected shell casings into said containment area and detent means on said container means for engagement in and disengagement from the opening in the handle portion of the rifle body for selectively mounting said container means with its said shell deflecting portion in facing relation to the shell ejection port of the rifle, said detent means including a shoulder for engagement with the main body portion, and engagement member mounted on said shoulder to be in adjacent facing relation to the opening when said shoulder is positioned in engagement with the main body portion, and yieldable biasing means for urging said engagement member into the opening.

2. A device for catching and holding rifle shell casings ejected from a rifle according to claim 1 and characterized further in that said container means comprises a container portion defining said containment area, said container portion being detachable from said shell deflecting portion.

3. A device for catching and holding rifle shell casings ejected from a rifle according to claim 2 and characterized further in that said container portion comprises a flexible bag.

4. A device for catching and holding rifle shell casings ejected from a rifle according to claim 3 and characterized further in that said flexible bag has a stretchable edge portion defining an entrance opening into said containment area and said deflecting portion includes a lip for retaining engagement with said edge portion of said bag.

5. A device for catching and holding rifle shell casings ejected from a rifle according to claim 1 and characterized further in that said shell deflecting portion includes a flange for lateral engagement with the handle portion when said shoulder and engagement member are engaged respectively with the main body portion and the opening.

* * * * *

UNITED STATES PATENT AND TRADEMARK OFFICE

CERTIFICATE OF CORRECTION

PATENT NO. : 5,138,787

DATED : August 18, 1992

INVENTOR(S) : Ronald E. Riddle and Travis O. Riddle

It is certified that error appears in the above-identified patent and that said Letters Patent is hereby corrected as shown below:

Column 1, line 18, delete "semiautomatic" and insert therefor -- semi-automatic --.

Column 3, line 31, after "24" insert -- . --.

Column 4, line 28, after "described" insert -- . --.

Column 4, line 31, delete "firinq" and insert therefor -- firing --.

Column 5, line 20, delete "and" and insert therefor -- an --.

Signed and Sealed this

Fourteenth Day of September, 1993

Bruce Lehman

*Attest:*

BRUCE LEHMAN

*Attesting Officer*

*Commissioner of Patents and Trademarks*